US005889368A

United States Patent [19]

Doell et al.

[11] Patent Number: 5,889,368

[45] Date of Patent: Mar. 30, 1999

[54] HIGH INTENSITY ELECTRODELESS DISCHARGE LAMP WITH PARTICULAR METAL HALIDE FILL

[75] Inventors: Gerhard W. Doell, Beverly; Walter P. Lapatovich, Boxford, both of Mass.

[73] Assignee: Osram Sylvania Inc., Danvers, Mass.

[21] Appl. No.: 909,382

[22] Filed: Aug. 11, 1997

[51] Int. Cl.[6] ..... H01J 17/20

[52] U.S. Cl. ..... 313/637; 313/493

[58] Field of Search ..... 313/234, 607, 313/637, 638, 639, 640, 614, 642

[56] References Cited

U.S. PATENT DOCUMENTS

| | | | |
|---|---|---|---|
| 4,983,889 | 1/1991 | Roberts | 315/245 |
| 5,070,277 | 12/1991 | Lapatovich | 315/248 |
| 5,113,121 | 5/1992 | Lapatovich et al. | 315/248 |
| 5,256,940 | 10/1993 | Wada et al. | 315/248 |
| 5,343,118 | 8/1994 | Chang | 313/637 |
| 5,382,873 | 1/1995 | Scholl et al. | 313/570 |
| 5,404,076 | 4/1995 | Dolan et al. | 313/572 |
| 5,606,220 | 2/1997 | Dolan et al. | 313/637 |
| 5,691,601 | 11/1997 | Frey et al. | 313/571 |

*Primary Examiner*—Sandra O'Shea
*Assistant Examiner*—Matthew J. Gerile
*Attorney, Agent, or Firm*—William H. McNeill

[57] ABSTRACT

An electrodeless high intensity discharge (EHID) lamp is disclosed for photo optical applications, such as videoprojection. The lamp contains a specific chemical fill that makes it useful as a light source for videoprojectors. The chemical fill completely vaporizes during operation, and comprises $AlI_3$, InI, and an iodide of a metal selected from the group consisting of Th, Hf and Zr.

11 Claims, 5 Drawing Sheets

HIGH INTENSITY ELECTRODELESS DISCHARGE LAMP WITH PARTICULAR METAL HALIDE FILL

FIELD OF THE INVENTION

The invention relates to videoprojection lamps and, more particularly, to an electrodeless high intensity discharge lamp for use as a videoprojection light source.

Background of the Invention

Videoprojection lamps are light sources having special spectral characteristics. They are generally used for television or data/computer graphics projection. The images created by these systems are developed either by absorption through LCD slides, or by reflection on Digital Micromirror Devices (DMD).

In all of these applications, a separation of the red, green, and blue content of the spectrum is required in order to display color information. Therefore, the desired spectrum must contain emission in the whole visible region, and especially in the red portion thereof, at wavelengths between 610 and 720 nm. Mercury and metal halide lamps are not generally usable for this purpose, because most conventional mercury (Hg) and metal halide lamps lack a sufficient red portion in the emission spectrum.

In addition to the need for a satisfactory red content, a relatively high color temperature of more than 6000° K, is also desirable in order to increase the brightness of the display, so as to provide an image that appears similar to those of conventional CRT displays.

Electrodeless high intensity discharge (HID) lamps exhibit better maintenance characteristics, due to the absence of problems associated with electrodes, such as electrode melt back, wall blackening, and press seal cracks. The same benefits also inure to electrodeless videoprojection lamps.

One drawback of using electrodeless high intensity discharge lamps for videoprojection, however, is that the fill chemistries usually employed for electroded HID lamps are not directly transferable. This is due to the fact that the electrodes of HID lamps influence the emission spectrum.

The present invention is an electrodeless HID lamp having a fill that satisfies the aforementioned color and temperature requirements needed for videoprojection.

Discussion of Related Art

Currently, lamps for videoprojection applications are electroded high intensity discharge lamps using a mixture of metal halides and Hg. In some cases, a saturated fill of rare earth iodides, such as $DyI_3$ and $NdI_3$, is used in combination with an alkali iodide such as CsI. These types of chemistries, however, form a condensate that interferes with the optical system. Unsaturated fills containing high pressure mercury, or high vapor pressure metal halides, such as $AlI_3$, InI, and $HgBr_2$, do not form a condensate at the operating wall temperatures; consequently, they do not negatively affect the optical system.

Electrodeless lamps have been using Hg as the buffer gas, and a saturated mixture of metal halides, such as NaI and $ScI_3$, to fill the emission spectrum according to desired photometric properties. So far, unsaturated electrodeless lamps have been limited to a high pressure fill of mercury, xenon or sulfur. Fill chemistries developed for electroded videoprojection lamps that have been utilized in electrodeless lamps have resulted in inferior videoprojection lamp performance and poor photometric characteristics.

DISCLOSURE OF THE INVENTION

In accordance with one aspect of the present invention, there is provided an electrodeless high intensity discharge (EHID) lamp for photo optical applications, such as videoprojection. The lamp contains a specific chemical fill that makes it useful as a light source for videoprojectors. The volume of the lamp varies between approximately 0.001 $cm^3$ and 1.000 $cm^3$, with a preferred volume of approximately 0.012 $cm^3$. The input power of the lamp varies between approximately 20 Watts and 500 Watts, with 100 Watts being preferable. The EHID lamp, made from vitreous silica, is approximately cylindrical in shape. Such a lamp construction has been described previously in U.S. Pat. Nos. 5,070,277 and 5,113,121, the teachings of which are hereby incorporated by reference.

The fill of this invention consists of a mixture of $AlI_3$, InI and $ThI_4$. This mixture is introduced into the EHID lamp, together with Hg and a buffer gas, such as Ar, Kr or Xe at a cold fill pressure between approximately 5 and 50 torr. Instead of Hg, high pressure Xe can also be used as a buffer gas, providing a Hg-free metal halide lamp that is environmentally friendly.

The weight ratio of $AlI_3$:InI:$ThI_4$ in the fill varies between approximately 90:0:10 and 10:20:70. The preferred composition in weight percent of $AlI_3$:InI:$ThI_4$ is 69:11:20.

It is an object of this invention to provide an improved videoprojection lamp.

It is another object of the invention to provide an electrodeless high intensity discharge (EHID) lamp for photo optical applications, such as videoprojection.

It is a further object of this invention to provide a chemical fill for an EHID lamp suitable for videoprojection, and which does not form the usual, undesirable condensate.

BEST MODE FOR CARRYING OUT THE INVENTION

Generally speaking, the invention features an electrodeless high intensity discharge (EHID) lamp with a chemical fill suitable for videoprojection. The fill of this invention does not form the usual, undesirable condensate. At operating temperature, the fill components are completely vaporized, and do not interfere with the optical imaging in a negative way.

Figure 1:
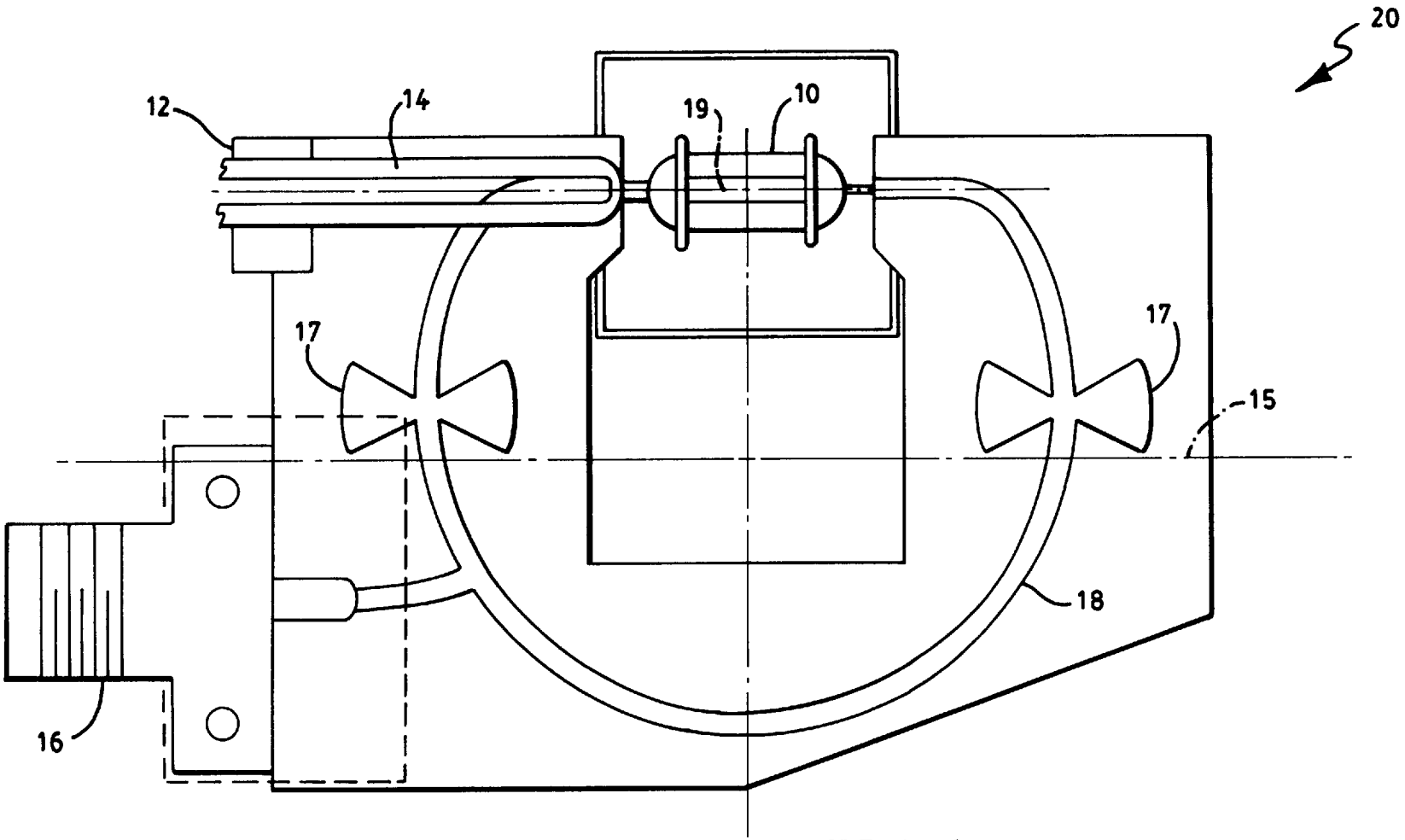
FIG. 1 illustrates a schematic view of a typical electrodeless high intensity discharge (EHID) lamp and power applicator assembly in accordance with this invention.

Now referring to FIG. 1, a typical electrodeless high intensity discharge lamp and power applicator assembly 20 is illustrated in accordance with this invention. The lamp and power applicator assembly 20 comprises a ceramic substrate 15, and a support block 12 that carries the lamp stem 14 of a light-transmitting envelope 10 of the lamp. A high frequency connector 16 provides power to the assembly 20 via a transmission line 18. Tuning stubs 17 are used to adjust the impedance to ensure maximum power transfer to the light-transmitting envelope 10. A discharge 19 is emitted from the center portion of the light-transmitting envelope 10, containing a chemical fill.

The volume of the lamp 10 varies between approximately 0.001 $cm^3$ and 1.000 $cm^3$, with a preferred volume of approximately 0.012 $cm^3$. The input power of the lamp 10 varies between approximately 20 Watts and 500 Watts, with 100 Watts being preferable. The EHID lamp is made from vitreous silica and is approximately cylindrical in shape. Such a lamp construction has been previously described in U.S. Pat. Nos. 5,070,277 and 5,113,121.

The fill of this invention consists of a mixture of $AlI_3$, InI and $ThI_4$. This mixture is introduced into the EHID lamp, together with Hg and a buffer gas, such as Ar, Kr or Xe at a cold fill pressure between approximately 5 and 50 torr. Instead of Hg, high pressure Xe can also be used as a buffer gas, providing a Hg-free metal halide lamp that is environmentally friendly.

The weight ratio of $AlI_3$:InI:$ThI_4$ in the fill varies between approximately 90:0:10 and 10:20:70. The preferred composition in weight percent of $AlI_3$:InI:$ThI_4$ is 69:11:20.

Figure 2:
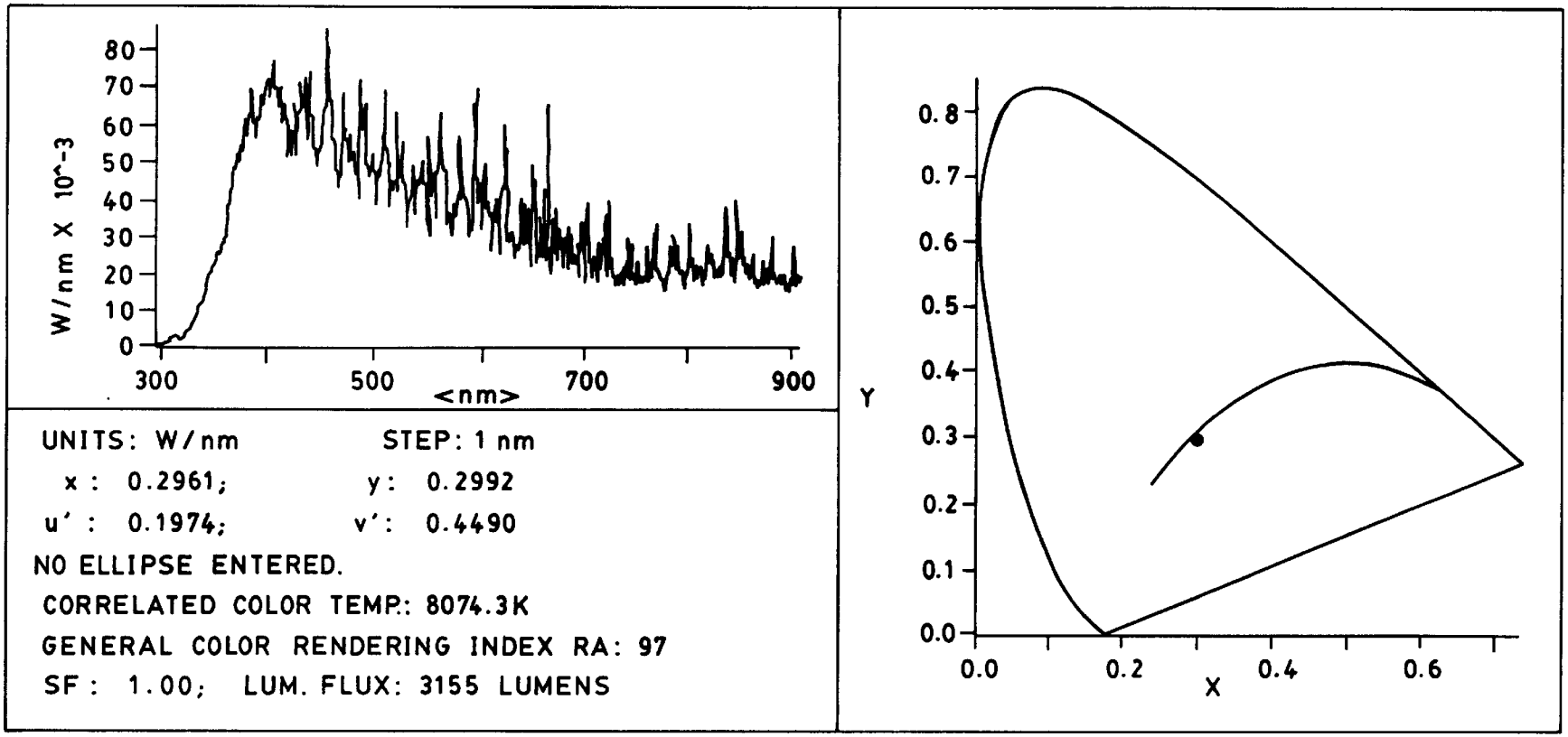
FIG. 2 depicts a graphical view of an emission spectrum and photometric characteristics of an electrodeless high intensity discharge (EHID) lamp containing a fill chemistry in accordance with the invention.

Referring to FIG. 2, an emission spectrum is illustrated for a cylindrical lamp 2 mm ID, 4 mm OD and 10 mm internal length EHID envelope 10 (FIG. 1). The envelope 10 is filled with 2.65 $mg \cdot cm^{-3}$ of the preferred chemistry, 22.6 $mg \cdot cm^{-3}$ of Hg, and 5 torr of argon, running at an input power of 45 Watts.

Figure 3:
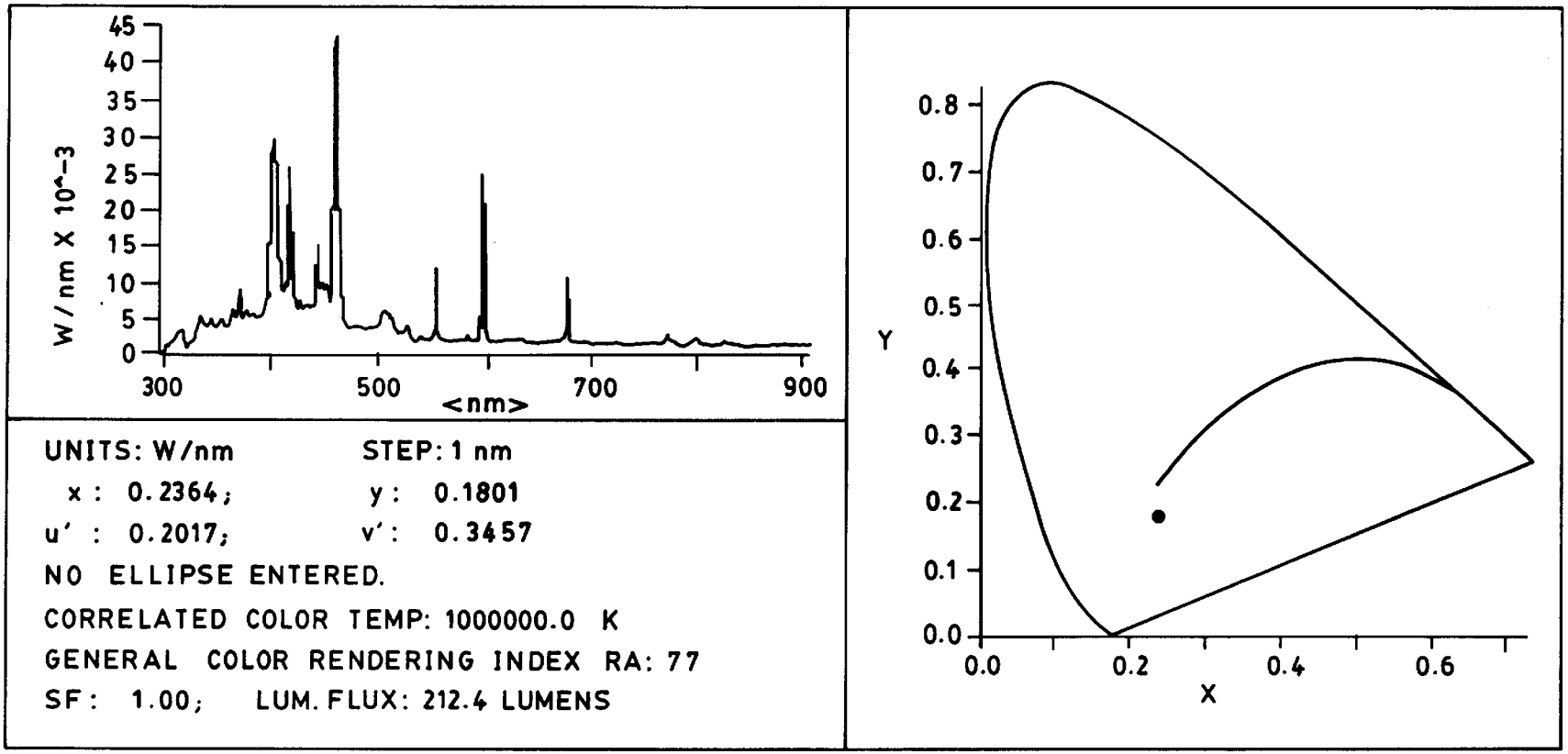
FIG. 3 shows a graphical view of an emission spectrum and photometric characteristics of an electrodeless high intensity discharge (EHID) lamp containing a fill chemistry intended for electroded lamps.

Referring to FIG. 3, a comparison emission spectrum of a second EHID lamp 10 at the same power is shown. This envelope 10 was filled with a chemical fill presently used in electroded videoprojection lamps consisting of $AlI_3$, InI, $HgBr_2$, Hg and argon. In a preferred embodiment the arc tube is smaller, approximately 2×3×6 mm. Also, the envelope would be filled with approximately 4.8 mg $cm^{-3}$ of the preferred chemistry, 13.4 mg $cm^{-3}$ of Hg, and about 5 torr of argon, running at an input power of 100 W.

It can be seen from FIG. 3 that the chemistry designed for electroded videoprojection lamps is not suitable for use in electrodeless lamps. The emission is centered mostly in the UV and blue region of the spectrum, with almost no emission in the red portion. The modified chemistry of the instant invention, by comparison, has a continuous emission in the whole visible spectrum, with an excellent red portion. Moreover, the general color rendering index Ra is very high (97). The color temperature is close to 8000° K, as desired in video projection lamps. The luminous efficacy of this lamp was about 70 lumen per watt. This value is very high, considering that the color temperature requirements for the lamp shifted the maximum of the emission spectrum to the blue portion of the visible spectrum, where eye sensitivity is reduced. The color temperature of the lamp can be changed by modifying the amount of $AlI_3$ and $ThI_4$ in the fill.

Figure 4:
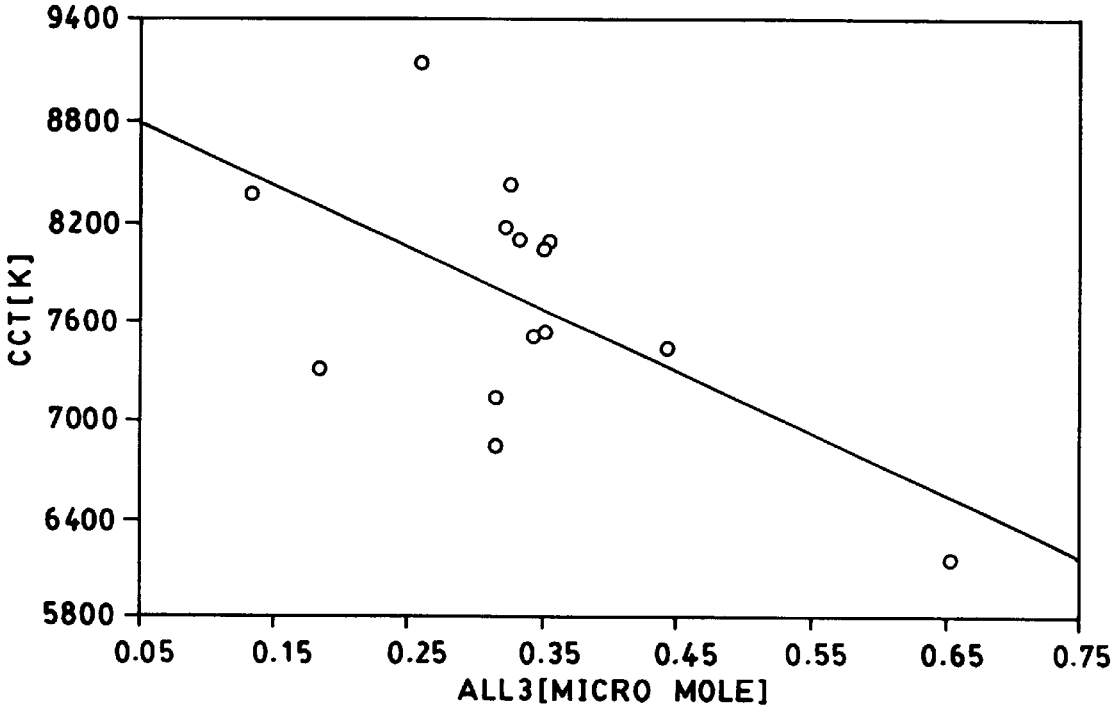
FIGS. 4 and 5 illustrate graphical views of color temperature variation as a function, respectively, of $AlI_3$ and $ThI_4$.
Figure 5:
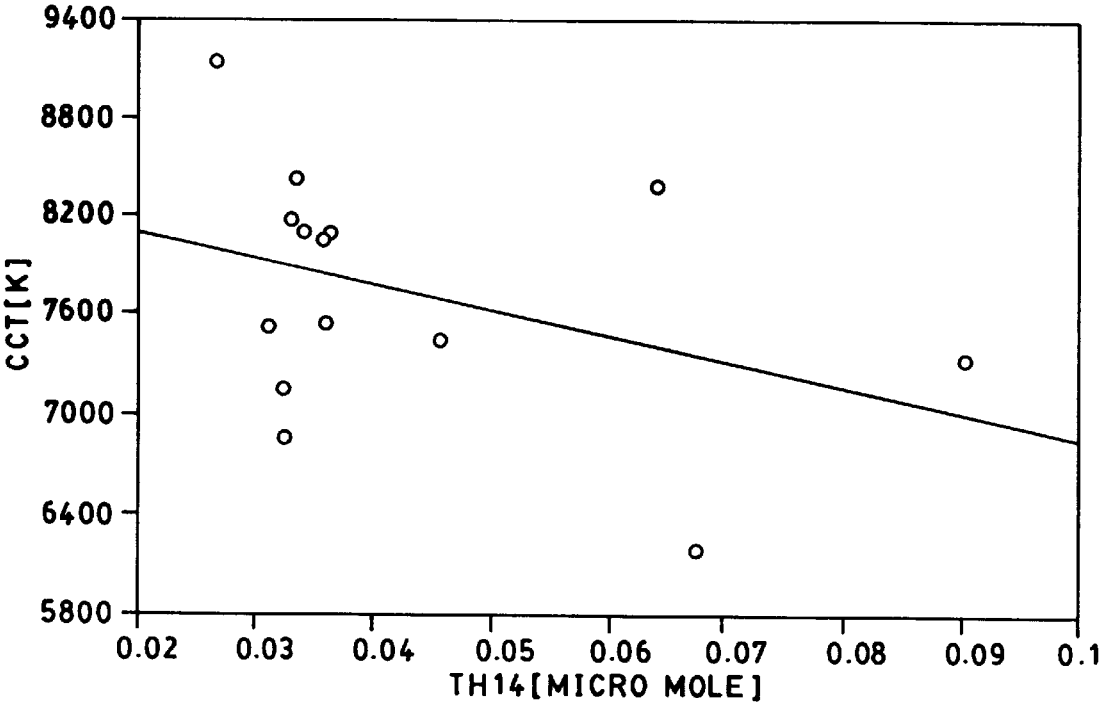

Referring to FIGS. 4 and 5, a graphical view is shown which demonstrates that the color temperature can be lowered by almost 3000° K, when increasing the $AlI_3$ and $ThI_4$ amounts in the envelope 10. Therefore, modified requirements for color temperature can be met by simple change of the fill composition without any change in the other lamp parameters. This is a valuable feature.

The fill of this invention does not form the usual, undesirable condensate. At operating wall temperature, the fill components are completely vaporized, and do not form a condensate which may interfere negatively with the optical imaging. This is referred to as operation in an unsaturated mode.

A high color temperature is desired for typical video, but a lower color temperature source may be desired, when displaying computer graphics.

Similar lamp performance can be achieved by using a fill chemistry where $ThI_4$ is replaced by $HfI_4$ or $ZrI_4$, which are chemically very similar to $ThI_4$, and have comparable emission characteristics.

Figure 6:
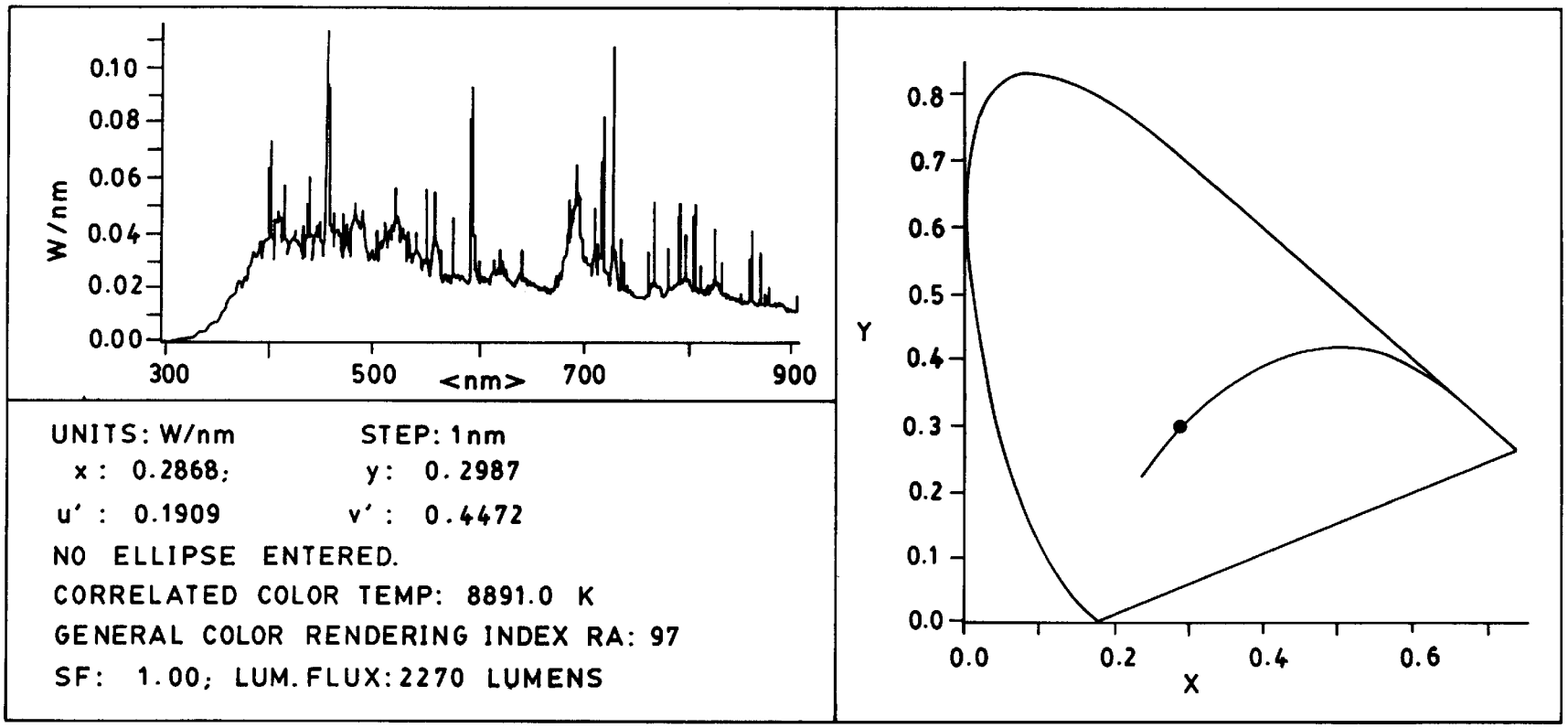
FIG. 6 depicts an emission spectrum and photometric characteristics of an electrodeless high intensity discharge lamp containing a fill chemistry of $AlI_3$, InI, $HFI_4$, Hg and Ar.

Referring to FIG. 6, there is shown a spectrum of an envelope 10 filled with 6.9 $mg \cdot cm^{-3}$ of a chemistry consisting of $AlI_3$:InI:$HfI_4$ in a ratio of 67:10:23 (wt. %), 16.6 $mg \cdot cm^{-3}$ of Hg and 5 torr of Ar. The photometric characteristics such as color temperature, color coordinates and red, green and blue content of the emission are very similar to lamps containing $ThI_4$, thus making them as useful for videoprojection applications as Th-containing lamps.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A capacitively coupled electrodeless videoprojection lamp comprising:

a light transmitting envelope having a volume of between 0.001 and 1.00 $cm^3$; and a fill disposed within said light transmitting envelope which is substantially vaporized during operation, whereby no condensate is left within the light transmitting envelope, said fill comprising $AlI_3$: InI: $ThI_4$, in an approximate weight ratio range between 90:0:10 and 10:20:70, and further including Hg and a noble gas.

2. The electrodeless lamp for use in photo optical applications in accordance with claim 1, wherein said noble gas is selected from a group of noble gases consisting of Ar, Kr and Xe.

3. The electrodeless lamp for use in photo optical applications in accordance with claim 1, wherein said fill has a chemistry comprising $AlI_3$: InI: $ThI_4$ in a weight ratio range of between approximately 90:0:10 and 10:20:70 and further comprising Ar.

4. The electrodeless lamp for use in photo optical applications in accordance with claim 1, wherein said fill has a chemistry comprising $AlI_3$: InI: $HfI_4$ in a weight ratio range of between approximately 90:0:10 and 10:20:70 and further comprising Hg and a noble gas.

5. The electrodeless lamp for use in photo optical applications in accordance with claim 4, wherein said noble gas is selected from a group of noble gases consisting of Ar, Kr and Xe.

6. The electrodeless lamp for use in photo optical applications in accordance with claim 1, wherein said fill has a chemistry comprising $AlI_3$: InI: $HfI_4$ in a weight ratio range of between approximately 90:0:10 and 10:20:70 and further comprising Ar.

7. The electrodeless lamp for use in photo optical applications in accordance with claim 1, wherein said fill has a chemistry comprising $AlI_3$: InI: $ZrI_4$ in a weight ratio range of between approximately 90:0:10 and 10:20:70 and further comprising Hg and a noble gas.

8. The electrodeless lamp for use in photo optical applications in accordance with claim 7, wherein said noble gas is selected from a group of noble gases consisting of Ar, Kr and Xe.

9. The electrodeless lamp for use in photo optical applications in accordance with claim 1, wherein said fill has a chemistry comprising $AlI_3$: InI: $ZrI_4$ in a weight ratio range of approximately between 90:0:10 and 10:20:70 and further comprising Ar.

10. A capacitively coupled electrodeless videoprojection lamp comprising:

a light transmitting envelope having a volume of between 0.001 and 1.00 $cm^3$; and a fill disposed within said light transmitting envelope which is substantially vaporized during operation, whereby no condensate is left within the light transmitting envelope, said fill having a chemistry comprising $AlI_3$, InI, and an iodide of a metal selected from the group consisting of Th, Hf and Zr and being present in an amount of about 2.65 $mg/cm^3$ and additionally containing 22.6 $mg/cm^3$ of Hg and 5 Torr of Ar.

11. The electrodeless lamp for use in photo optical applications in accordance with claim 10, wherein said fill further comprises at least one material of the group consisting of Hg, Ar, Kr and Xe.

* * * * *